US007144302B2

(12) United States Patent
Bolz et al.

(10) Patent No.: US 7,144,302 B2
(45) Date of Patent: Dec. 5, 2006

(54) METHOD FOR SMOOTHING THE SURFACE OF A GAS TURBINE BLADE

(75) Inventors: Andrea Bolz, Berlin (DE); Martin Feldhege, Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 11/185,821

(22) Filed: Jul. 21, 2005

(65) Prior Publication Data

US 2006/0246825 A1 Nov. 2, 2006

Related U.S. Application Data

(63) Continuation-in-part of application No. 10/451,911, filed on Jan. 5, 2004, now Pat. No. 7,014,533.

(30) Foreign Application Priority Data

Dec. 27, 2000 (EP) ..... 00128574

(51) Int. Cl.
*B24B 1/00* (2006.01)

(52) U.S. Cl. ..... 451/36; 451/113; 451/104

(58) Field of Classification Search ..... 451/36, 451/104, 113, 327
See application file for complete search history.

(56) References Cited

U.S. PATENT DOCUMENTS 4,321,310 A * 3/1982 Ulion et al. ..... 428/612
4,589,175 A * 5/1986 Arrigoni ..... 29/889.1
5,090,870 A * 2/1992 Gilliam ..... 416/241 R
5,105,525 A 4/1992 Firatli et al.
5,251,409 A * 10/1993 Orbank ..... 451/37
5,498,484 A * 3/1996 Duderstadt ..... 428/633
5,645,893 A 7/1997 Rickerby et al.
5,683,825 A 11/1997 Bruce et al.
5,702,288 A 12/1997 Liebke et al.
6,261,154 B1 * 7/2001 McEneny ..... 451/32
6,406,356 B1 * 6/2002 Brooks ..... 451/36
6,688,953 B1 * 2/2004 Kawasaki et al. ..... 451/327

FOREIGN PATENT DOCUMENTS

DE 28 48 029 A1 5/1980
DE 28 57 522 A1 6/1980
DE 39 18 824 A1 3/1990
EP 0761 386 A1 3/1997

* cited by examiner

*Primary Examiner*—Lee D. Wilson
*Assistant Examiner*—Anthony Ojini
(74) *Attorney, Agent, or Firm*—Harness, Dickey & Pierce, P.L.C.

(57) ABSTRACT

A surface of the gas turbine blade is smoothed by way of a drag finish process. A first ring-shaped container is filled with a liquid abrasive medium. A second container which is arranged next to the first container is filled with a second liquid abrasive medium. A pivoting arm is arranged between and above the containers and can be pivoted along a pivoting direction. A drag device is arranged on the pivoting arm. The drag device leads a gas turbine blade on a carrier arm through the abrasive medium.

14 Claims, 2 Drawing Sheets

METHOD FOR SMOOTHING THE SURFACE OF A GAS TURBINE BLADE

This application is a Continuation-In-Part Application of U.S. application Ser. No. 10/451,911, filed Jan. 5, 2004 now U.S. Pat. No. 7,014,533, which is the national phase under 35 USC § 371 of PCT International Application No. PCT/EP01/13982 filed on Nov. 29, 2001, which designated the United States of America, and which claims priority from European Patent Application No. EP 00128574.1 filed on Dec. 27, 2000, the entire contents of all of which are hereby incorporated herein by reference.

FIELD OF THE INVENTION

The present invention generally relates to a method of smoothing the surface of a gas turbine blade, in particular, a surface of a gas turbine blade having an anticorrosion layer.

BACKGROUND OF THE INVENTION

DE-A-39 18 824 and U.S. Pat. No. 5,105,525 show a flatiron sole which has an especially scratch-resistant, readily slidable and easy-to-clean surface. The flatiron sole is coated with a nickel hard alloy and is ground and polished by a drag finishing method.

A method of producing a coating on a gas turbine blade is described in U.S. Pat. No. 4,321,310. The gas turbine blade has a parent body made of a cobalt-base or nickel-base superalloy. An adhesive mediator layer of the MCrAlY type is applied to this parent material. In this case, M, for example, designates a combination of the metals nickel and cobalt. Cr stands for chrome and Al stands for aluminum, and Y stands for yttrium. A ceramic layer of zirconium oxide which has grown in a columnar manner is applied to this adhesive mediator layer, the columns being oriented essentially perpendicularly to the surface of the parent body. Before the zirconium oxide layer, serving as heat-insulating layer, is applied to the adhesive mediator layer, the adhesive mediator layer is polished until a surface roughness of about 1 μm appears.

U.S. Pat. No. 5,683,825 likewise discloses a method of applying a heat-insulating layer to a component of a gas turbine. An NiCrAlY adhesive mediator layer is applied to the parent body by low-pressure plasma spraying. The surface of the adhesive mediator layer is polished, so that it has a surface roughness of about 2 μm.

By way of a vapor deposition process (PVD, physical vapor deposition), a ceramic heat-insulating layer with yttrium-stabilized zirconium oxide is applied to the adhesive mediator layer polished in such a way. In this case, the heat-insulating layer is preferably applied with the "electron-beam PVD process." The heat-insulating layer may also be applied by way of plasma spraying.

The application of a heat-insulating layer to an adhesive mediator layer of a component of a gas turbine is likewise described in U.S. Pat. No. 5,498,484. The average surface roughness of the adhesive mediator layer is specified as at least above 10 μm.

U.S. Pat. No. 5,645,893 relates to a coated component having a parent body made of a superalloy and having an adhesive mediator layer and a heat-insulating layer. The adhesive mediator layer has a platinum aluminide and an adjoining thin oxide layer. The thin oxide layer has aluminum oxide. Adjoining this oxide layer is the heat-insulating layer, which is applied by way of the electron-beam PVD process. In this case, zirconium oxide stabilized with yttrium is applied to the adhesive mediator layer. Before the adhesive mediator layer is applied, the surface of the parent body is cleaned by way of a coarse sand blasting process. Aluminum oxide sand is used in this case in order to remove material from the parent body.

SUMMARY OF THE INVENTION

An object of the present invention is to specify a method of smoothing the surface of a gas turbine blade. A method according to an exemplary embodiment of the present invention provides an especially efficient and cost-effective manner of smoothing a surface of a gas turbine blade, which leads to a sufficiently smooth surface of the gas turbine blade.

According to an exemplary embodiment of the present invention, an object is achieved using a method of smoothing the surface of a gas turbine blade, in which the gas turbine blade is dragged with a drag device through an abrasive medium in a drag direction.

Therefore, it is proposed for the first time to smooth a gas turbine blade by a drag finishing method. It is surprisingly possible with such a drag finishing method to achieve qualitatively high-grade smoothing of the surface of the gas turbine blade in a very short time, to be precise without inhomogeneous material removal. Such inhomogeneous material removal would actually be expected in the case of such a drag finishing method on account of the complex and fluidically optimized shape of the turbine blade. In addition, such inhomogeneous material removal would locally impair the protective effect of the MCrAlY layer in an inadmissible manner.

The gas turbine blade may have an outer anticorrosion layer applied by thermal spraying. This anticorrosion layer also preferably includes an alloy of the class MCrAlX, where M stands for one or more elements of the group (iron, cobalt, nickel), Cr is chrome, Al is aluminum and X stands for one or more elements of the group (scandium, hafnium, lanthanum, rare earths). In the case of such an anticorrosion layer, there is in particular the need for very good smoothing of the surface of the gas turbine blade when a ceramic heat-insulating layer is subsequently to be applied to the anticorrosion layer.

The method may be applied to a gas turbine blade in which cooling passages for a cooling medium to be directed from the interior of the gas turbine blade open out at the surface. It may be necessary to cool a gas turbine blade during operation in order to permit use at very high temperatures. To this end, a cooling medium, in particular cooling air or steam, is directed into the hollow gas turbine blade and is directed from there via cooling passages to the surface. There, the cooling medium, discharges as a cooling film. It may be important to ensure the cooling passages are not subjected to any cross-sectional constriction, which would result in a reduction in the rate of flow of the cooling medium. Such a cross-sectional constriction could also occur, for instance, during the surface treatment of the gas turbine blade. For example, there is the risk that burrs which have been produced during the drilling of the cooling passages will not be removed during the surface abrasion but will possibly be pressed into the drill hole, a factor which leads to such a cross-sectional constriction. This risk is considerably reduced in the drag finishing process.

The gas turbine blade is preferably dragged in a multiaxial movement. The gas turbine blade is therefore not only guided statically in the drag direction but is also subjected to a further, superimposed movement about a plurality of axes.

In this case, the gas turbine blade is, for example, rotated or tilted about an axis perpendicularly to the drag direction. At the same time, the drag direction itself may also be defined by an axis of motion. The gas turbine blade is preferably rotated during the dragging. This movement may therefore also be a rotational movement which is performed by the gas turbine blade while it is dragged in a linear process. However, the gas turbine blade is preferably dragged on a circular path. The gas turbine blade is preferably tilted periodically perpendicularly to the drag direction. In particular, it is preferred that the gas turbine blade is dragged in a multiaxial movement, in the course of which it is dragged on a circular path and at the same time rotates and is tilted periodically perpendicularly to the drag direction.

This superimposition of movements ensures that the gas turbine blade is subjected to a homogenous abrasive process. The complex shape of the gas turbine blade, in particular the difference between the convex or concave shape of the suction or pressure side, there is the risk of nonuniform removal at the surface during the drag finishing. This is avoided by the described superimposition of movements, and thus in particular the surface shape, which is strictly predetermined aerodynamically, is maintained. A uniform layer thickness of an applied anticorrosion layer is thereby ensured.

The surface preferably has a roughness of Ra=5 to 13 μm before the smoothing and a roughness of Ra=0.05 to 1 μm after the smoothing.

After first smoothing in the abrasive medium, second smoothing in a second abrasive medium is effected, the final roughness which can be achieved by the second abrasive medium being smaller than the final roughness which can be achieved by the first abrasive medium. An especially high degree of smoothing is achieved by such a repeated abrasive process in different abrasive media. In particular, precisely two abrasive processes are effected, it being possible for the second abrasive process to be designated as a polishing operation. The abrasive medium is, for example, a liquid medium which may consist of water or an aqueous abrasive emulsion and contains abrasive bodies. The abrasive bodies of the first abrasive medium are preferably larger than the abrasive bodies of the second abrasive medium.

The above features may be combined with one another in any desired manner.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE EXEMPLARY EMBODIMENTS

The same designations have the same meaning in the different figures.

Figure 1:
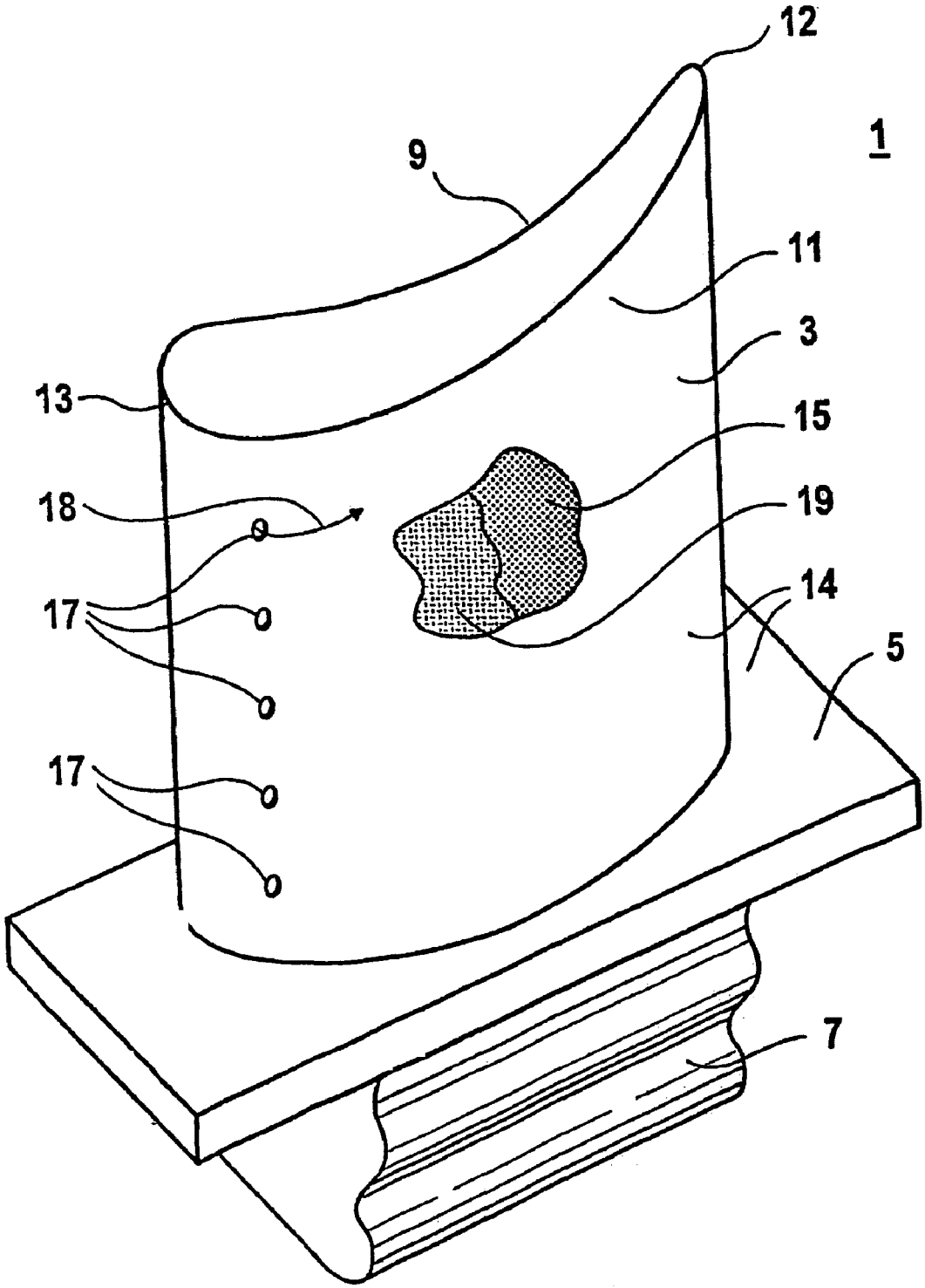
FIG. 1 shows a gas turbine blade according to an exemplary embodiment of the present invention.

FIG. 1 shows a gas turbine blade 1 with an airfoil 3, a platform 5 and a blade root 7. The airfoil 3 has a pressure side 9 and a suction side 11, which adjoin one another at a leading edge 13 and a trailing edge 12. The airfoil 3 as well as that surface of the platform 5 which faces the airfoil 3 are provided with an anticorrosion layer 15. The anticorrosion layer 15 is a metal alloy of the class MCrAlY. Cooling passages 17 open out at the surface 14 of the airfoil 3.

During operation, the gas turbine blade 1 is subjected to a hot gas at a very high temperature. The anticorrosion layer 15 serves to protect against corrosion and oxidation by the hot gas. For use at especially high temperatures, a ceramic heat-insulating layer 19 may also be applied to the anticorrosion layer 15. In this case, the anticorrosion layer 15 also serves as an adhesive mediator layer between the parent body of the gas turbine blade 1 and the ceramic heat-insulating layer 19. The anticorrosion layer 15 must be smoothed before such a ceramic heat-insulating layer 19 is applied. An efficient and cost-effective smoothing process is explained in more detail with reference to FIG. 2. To cool the gas turbine blade 1, a cooling medium 18, preferably cooling air, is directed out of the cooling passages 17. The cooling medium 18 forms a protective cooling film on the surface 14.

Figure 2:
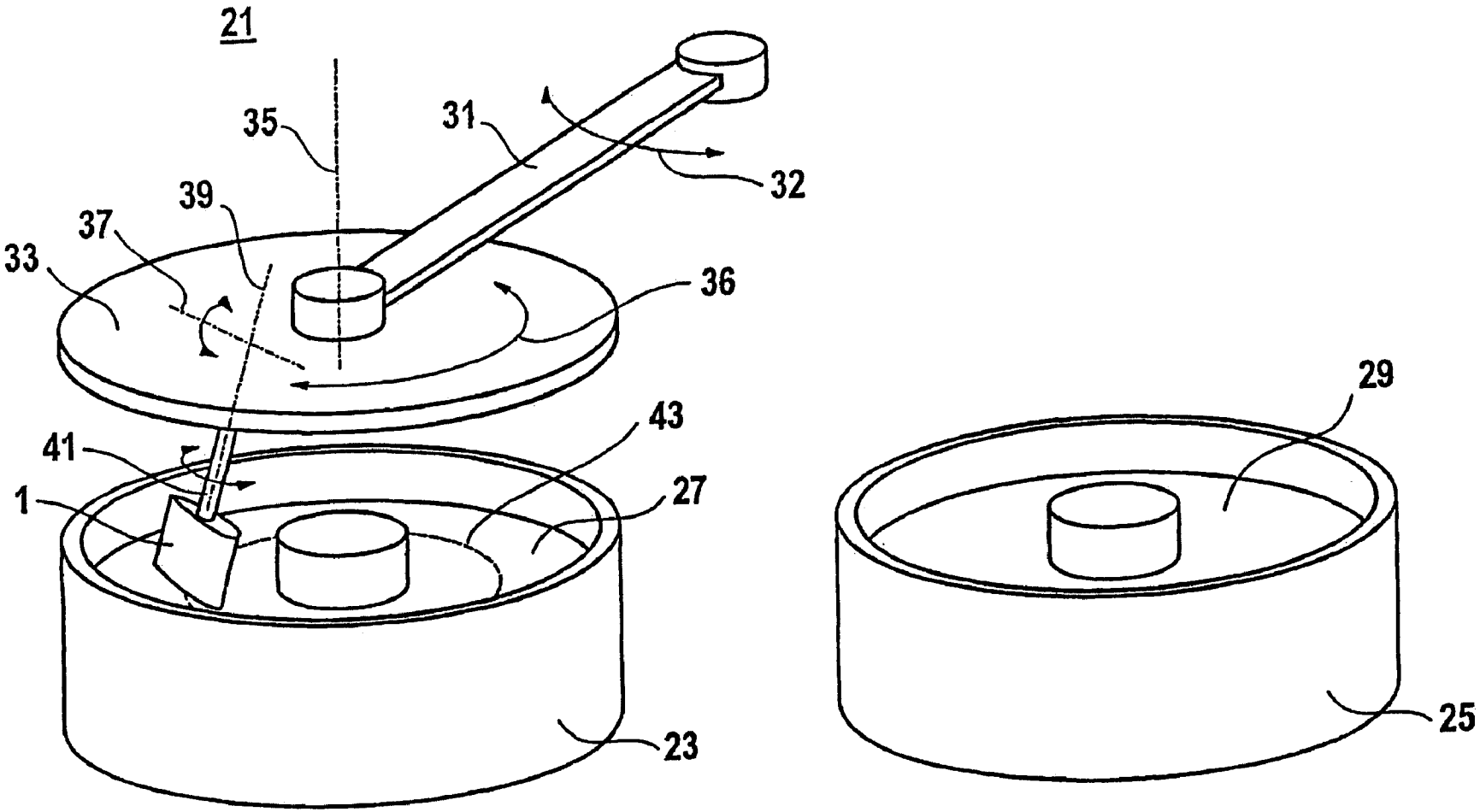
FIG. 2 shows an abrasive device and a method for the surface treatment of a gas turbine blade according to an exemplary embodiment of the present invention.

FIG. 2 shows an abrasive device 21. A first ring-shaped container 23 is filled with a liquid abrasive medium 27. A second container 25 arranged next to the first container 23 is filled with a second liquid abrasive medium 29. In an emulsion-like manner, the abrasive medium 27 contains abrasive bodies of a certain average size. In an emulsion-like manner, the second abrasive medium 29 contains second abrasive bodies, which on average are smaller than the abrasive bodies of the abrasive medium 27. Arranged between and above the containers 23, 25 is a pivoting arm 31, which is pivotable in a pivoting direction 32. The pivoting arm 31 can be pivoted in the pivoting direction 32 from a position above the first container 23 into a position above the second container 25. A drag device 33 is arranged on the pivoting arm 31. On a carrier arm 41, the drag device 33 guides a gas turbine blade 1 through the abrasive medium 27. In this case, a first axis 35 of the movement of the gas turbine blade 1 is defined by a rotation of the drag device 33. By the rotation about the first axis 35, the gas turbine blade 1 is dragged through the first container 23 along a circular path 43. A second axis 37 is defined by a tilting movement of the carrier arm 41 (together with the gas turbine blade 1) perpendicularly to the drag direction 36 defined by the rotation movement about the first axis 35. A third axis 39 for the movement of the gas turbine blade 1 is defined by a rotation of the carrier arm 41.

In an example, non-limiting embodiment, the rotation of the turbine blade 1 around the third axis 39 may be determined by the movement of the turbine blade 1 around the first axis 35. That is, there may be no active control of the rotational movements of the turbine blade 1 around the third axis 39. Instead, as the turbine blade 1 travels through the abrasive medium 27 along the path 43, forces may act on the irregular shape of the turbine blade 1 causing the turbine blade 1 to rotate about the third axis 39. In this regard, the turbine blade 1 may be considered as being freely rotatable (as opposed to being positively driven by a motor, for example, to rotate) around the third axis 39. In addition, the rotation of the turbine blade 1 around the second axis 37 may be determined by the movement of the turbine blade 1 around the first axis 35. That is, there may be no active control of the rotational movements of the turbine blade 1 around the second axis 37. Alternatively, a drive mechanism (such as a motor, for example) may be implemented to positively drive the turbine blade 1 to rotate around the second axis 37.

The intensity of the material removal can be set by the speed of the drag movement in the drag direction 36. The homogeneity of material removal on the surface 14 of the gas turbine blade 1 can be set by the relative speeds of the movements about the axes 35, 37, 39.

After sufficient smoothing in the abrasive medium 27, the drag device 33 is pivoted with the pivoting arm 31 over the second container 25. An analogous abrasive process is effected here, although a polishing operation, by way of which an especially high degree of smoothing can be achieved, is effected in the second abrasive medium 29.

A multiplicity of gas turbine blades 1 may of course also be arranged on the drag device 33, so that a high throughput of gas turbine blades 1 can be achieved.

Exemplary embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

We claim:

1. A method of smoothing a surface of a gas turbine blade, comprising:

dragging the gas turbine blade through an abrasive medium in a multi axial movement on a circular path around a first axis; and during dragging, rotating the gas turbine blade around a second axis that is perpendicular to a drag direction, the rotation of the gas turbine blade around the second axis being determined by the movement of the gas turbine blade around the first axis.

2. The method as claimed in claim 1, further comprising applying an outer anticorrosion layer to the gas turbine blade by way of thermal spraying.

3. The method as claimed in claim 2, wherein the anticorrosion layer includes an alloy of the class MCrAlX, where M stands for at least one of iron, cobalt, and nickel, Cr is chrome, Al is aluminum, and X stands for at least one of scandium, hafnium, lanthanum, and rare earth elements.

4. The method as claimed in claim 1, further comprising cooling passages for a cooling medium, the cooling passages spanning from an interior of the gas turbine blade to the surface.

5. The method as claimed in claim 1, further comprising periodically tilting the gas turbine blade at a ninety degree angle perpendicular to the drag direction.

6. The method as claimed in claim 1, wherein the surface has a roughness of Ra=5 to 13 micrometers before the smoothing and a roughness of Ra=0.05 to 1 micrometer after the smoothing.

7. The method as claimed in claim 1, further comprising:

smoothing the gas turbine blade in the abrasive medium; and smoothing the gas turbine blade in a second abrasive medium after smoothing in the abrasive medium, wherein a roughness achieved by the second abrasive medium is less than a roughness achieved by the abrasive medium.

8. The method as claimed in claim 1, wherein dragging includes dragging the gas turbine blade with a drag device.

9. The method as claimed in claim 1, further comprising periodically tilting the gas turbine blade perpendicularly to the drag direction.

10. A method, comprising:

dragging a work piece through an abrasive medium in a multi axial movement that includes moving the work piece in a drag direction on an arcuate path around a first axis, and simultaneously rotating the work piece around a second axis that is perpendicular to the drag direction, the rotation of the work piece around the second axis being determined by the movement of the work piece around the first axis.

11. The method as claimed in claim 10, wherein dragging includes dragging the work piece in a circular motion.

12. The method as claimed in claim 10, further comprising positioning the work piece in various positional angles during the dragging process.

13. The method as claimed in claim 10, further comprising regulating a speed of the dragging, wherein the speed is regulated such that a plurality of speeds are used during the dragging.

14. The method as claimed in claim 10, wherein dragging includes dragging the work piece through a first dragging medium, and subsequently dragging the work piece through a second dragging medium.

* * * * *